US007918361B2

(12) United States Patent
Geis

(10) Patent No.: US 7,918,361 B2
(45) Date of Patent: Apr. 5, 2011

(54) LID STORAGE AND WASHING CONTAINER

(76) Inventor: Carrie L. Geis, Plano, TX (US)

( * ) Notice: Subject to any disclaimer, the term of this patent is extended or adjusted under 35 U.S.C. 154(b) by 1069 days.

(21) Appl. No.: 11/679,270

(22) Filed: Feb. 27, 2007

(65) Prior Publication Data

US 2007/0138186 A1 Jun. 21, 2007

Related U.S. Application Data

(63) Continuation-in-part of application No. 10/964,148, filed on Oct. 13, 2004, now abandoned.

(51) Int. Cl.
*B65D 6/08* (2006.01)
*A47G 19/08* (2006.01)

(52) U.S. Cl. ..... 220/488; 211/41.9; 211/41.11; 220/487; 220/494

(58) Field of Classification Search ..... 220/486, 220/488, 532, 533, 534, 487, 494; 211/81–84, 211/41.11, 41.8, 41.9, 181.1; 312/326–329
See application file for complete search history.

(56) References Cited

U.S. PATENT DOCUMENTS

| | | | | |
|---|---|---|---|---|
| 4,118,081 | A | 10/1978 | Barrientos | |
| D252,440 | S | 7/1979 | Hamilton | |
| 4,192,432 | A * | 3/1980 | Jordan | 220/676 |
| 4,494,667 | A * | 1/1985 | Griffith | 220/486 |
| 4,498,594 | A | 2/1985 | Elder | |
| 4,512,489 | A * | 4/1985 | Green et al. | 220/488 |
| 4,517,231 | A * | 5/1985 | May et al. | 428/36.92 |
| 4,732,291 | A * | 3/1988 | McConnell | 220/488 |
| 4,830,200 | A | 5/1989 | Zambano | |
| 4,836,392 | A | 6/1989 | Constantino | |
| 5,000,326 | A | 3/1991 | Vaughn | |
| 5,207,334 | A | 5/1993 | Lear | |
| 5,344,029 | A | 9/1994 | Oghia | |
| 5,497,890 | A | 3/1996 | Clark | |
| 5,626,242 | A | 5/1997 | Weizer | |
| 5,660,284 | A | 8/1997 | Vaughn | |
| 5,840,261 | A | 11/1998 | Monch | |
| D401,811 | S | 12/1998 | Hait | |
| 5,881,906 | A * | 3/1999 | Rogers et al. | 220/607 |
| D411,783 | S | 7/1999 | Kualaau | |
| 6,039,202 | A * | 3/2000 | Olstad et al. | 220/533 |
| 6,814,091 | B2 * | 11/2004 | McConnell et al. | 134/135 |
| 6,915,808 | B2 * | 7/2005 | McConnell et al. | 134/135 |
| 7,044,424 | B2 * | 5/2006 | Robertson et al. | 248/311.2 |

* cited by examiner

*Primary Examiner* — Anthony Stashick
*Assistant Examiner* — Niki M Eloshway

(57) ABSTRACT

A device for containing plastic container lids for use in an automatic dishwasher or for storage. The device includes an open lattice structure having a top, bottom, back and side walls and a removable door. The lattice members preferably have convex outer surfaces and substantially planar interior surfaces and are configured to maximize water penetration into the device during a wash cycle. Longitudinally-oriented lattice members include projections and grooves that assist in retaining lids in position and maintaining separation between adjacent lids. Concentric circular members may be provided on the sides of the device.

8 Claims, 7 Drawing Sheets

LID STORAGE AND WASHING CONTAINER

CROSS REFERENCE TO RELATED APPLICATION

This application is a continuation-in-part of U.S. patent application Ser. No. 10/964,148, filed Oct. 13, 2004 now abandoned, which is incorporated by reference as if fully set forth herein.

STATEMENT REGARDING FEDERALLY FUNDED RESEARCH AND DEVELOPMENT

The invention described in this patent application was not the subject of federally sponsored research or development.

FIELD

The present invention relates to a container for washing and storing plastic lids for plastic and other lidded containers.

BACKGROUND

Plastic storage containers, such as the well-known Tupperware® brand containers, are widely used. These containers typically have a grooved plastic lid which is sealable over a lip on a plastic bowl. Similar plastic lids are used on non-plastic containers as well since the plastic lids can readily be formed to sealingly engage the upper lips of containers. As a result, many kitchens contain a plethora of plastic lids of various sizes and shapes. These plastic container lids are awkward to store since they are not conveniently storable when mated with their matching containers, which matching containers are commonly stored in a nested configuration without their lids. Such plastic container lids are also difficult to wash using an automatic dishwasher because they tend to move around or separate from the racks within a dishwasher during a washing cycle. Thus, when hit by the streams of water from the jets found in modern automatic dishwashers, movement of the plastic container lids results in uneven cleaning and damage to the plastic container lids particularly if the plastic container lids come in contact with the dishwasher heating element.

There have been numerous attempts to develop improved systems for storing plastic container lids. Some of such attempts to develop improved systems for storing plastic container lids are shown in U.S. Patents Des. 252,440 issued Jul. 24, 1979 to William P. Hamilton; Des. 401,811 issued Dec. 1, 1998 to Helen Hait; Des. 411,783 issued Jul. 6, 1999 to Frances Kualaau; U.S. Pat. No. 5,000,326 issued Mar. 19, 1991 to Richard C. Vaughn; U.S. Pat. No. 5,207,334 issued May 4, 1993 to John E. Lear; U.S. Pat. No. 5,344,029 issued Sep. 6, 1994 to Ann T. Oghia, et al; and, U.S. Pat. No. 5,660,284 issued Aug. 26, 1997 to Richard C. Vaughn. While a variety of techniques for storing plastic container lids have been disclosed in these references, none of the devices disclosed in these references address the difficult problem of cleaning soiled plastic container lids.

SUMMARY

The plastic container lid washing and storage container of the present invention disclosed herein includes a parallelepiped body having a top, bottom, left side and right side, a closed end and an open end. The top, bottom, left side, right side and the closed end each preferably have an open structure. The bottom includes a plurality of bottom rails. Each of the bottom rails is preferably parallel to the left and right side walls and has an inward-facing surface and an outward-facing surface. Also included are a plurality of projections located along the inward-facing surface of each of the bottom rails. Each of the projections is preferably no more than about 0.5 inches in height. These projections will be preferably located straight across the middle on the bottom, across the middle on the back and a row of projections across middle of the top. Such projections may be varied in shape and location to best hold the plastic container lids in position during a washing cycle within a dishwasher.

In another respect, the invention includes a parallelepiped body having an open structure, including a top, a bottom, a left side a right side, a closed end and an open end. Also provided are plurality of rails extending along the top and bottom walls from the open end toward the closed end. Each of the plurality of rails preferably has a substantially flat inward-facing surface and a convex outward-facing surface. A plurality of grooves are also preferably included in the rails. Each of the plurality of grooves are located on the inward-facing surface of one of the plurality of rails and extending from the open end toward the closed end.

In the preferred embodiment, the invention includes a body having an open structure, including a top, a bottom, a left side, a right side, a closed end and an open end forming substantially a right parallelepiped. The left side and the right side each preferably include a circular member. Also included are a plurality of grooved rails extending along the top and bottom walls from the open end toward the closed end. Each of the top, bottom, and back grooved rails preferably includes a plurality of projections located along its inward-facing surface.

DESCRIPTION OF THE EMBODIMENTS

Figure 1:
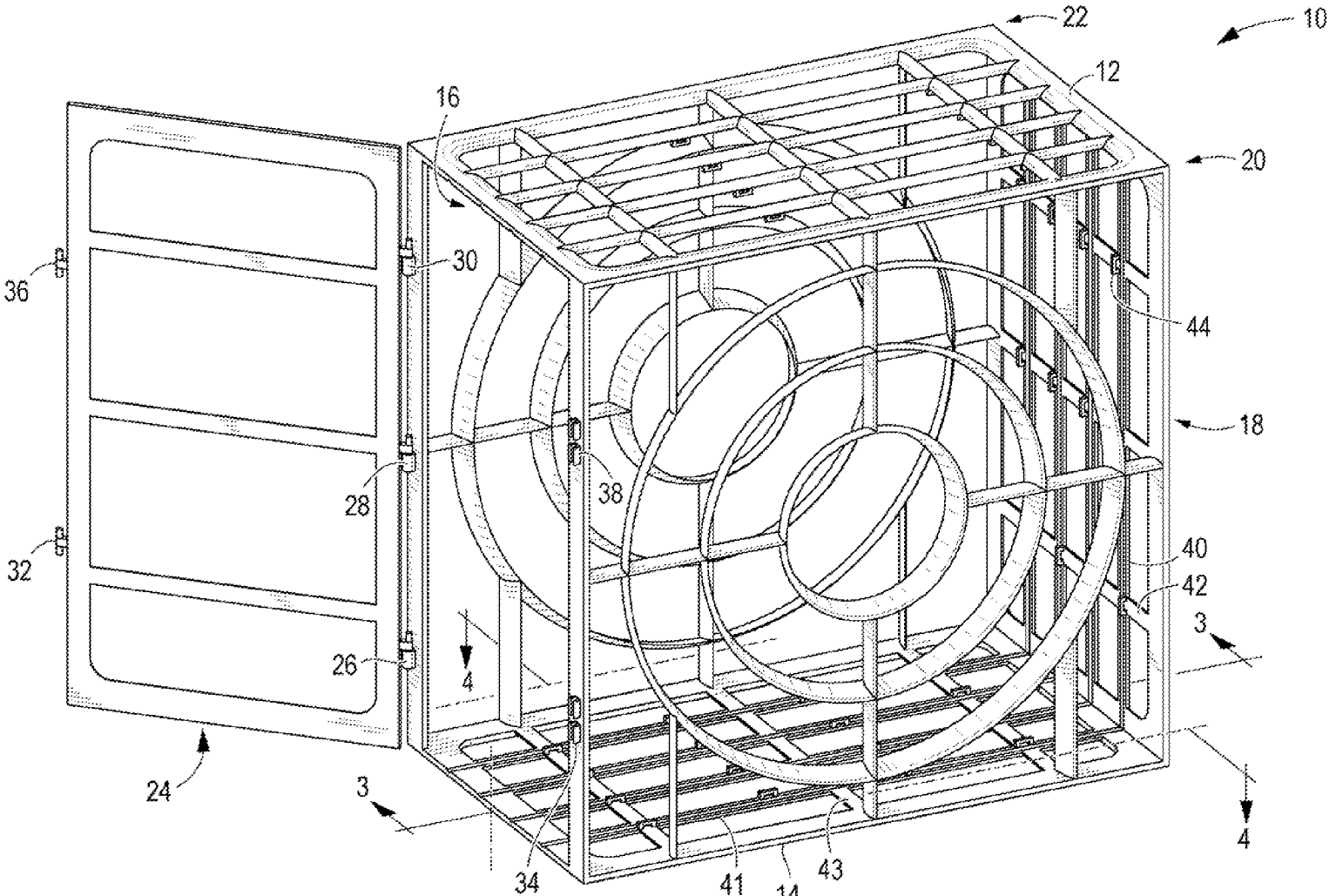
FIG. 1 is a perspective view of a plastic lid container according to the present invention.

The ensuing description provides exemplary embodiments of the invention only, and is not intended to limit the scope, applicability, or configuration of the invention. Rather, the ensuing description of the exemplary embodiments will provide those skilled in the art with an enabling description for implementing the exemplary embodiments of the invention. It being understood that various changes may be made in the function and arrangement of elements without departing from the spirit and scope of the invention, as set forth in the appended claims.

To aid in describing the invention, directional terms are used in the specification and claims to describe portions of the present invention (e.g., top, bottom, upper, lower, left, right, etc.). These directional definitions are merely intended to assist in describing the invention and are not intended to limit the invention in any way. In addition, reference numerals that are introduced in the specification in association with a drawing figure may be repeated in one or more subsequent figures without additional description in the specification to provide context for other features.

The purpose of the plastic lid container of the present invention is two-fold. First, the plastic lid container is designated to retain the plastic container lids in a position where they can be thoroughly washed to facilitate a thorough cleaning of the plastic container lids contained therein in an automatic dishwasher. Second, the disclosed plastic lid container provides a convenient and organized means for storing plastic container lids or other similarly shaped items in a cupboard, drawer, pantry and the like.

It is very difficult to thoroughly clean modern plastic container lids by hand. Thorough, sterile washing of such plastic container lids is important because the plastic container lids often come in contact with food elements, such as oils and sauces, which can leave a tough residue on the surface of the plastic container lids and in the grooves formed therein. Such residue may become moldy and contaminate the plastic container lid for future use. Some foods, such as tomato sauce, can also stain the plastic container lids. It is very difficult to hand wash such plastic container lids using water that is sufficiently hot to provide some degree of sterilization.

In addition, plastic container product makers, such as Tupperware, Inc., are now making plastic container lids with tighter (i.e., narrower) seal grooves, which provide more airtight seals, and therefore, prolong freshness for food stored in the container. This makes thoroughly washing such plastic container lids with tighter seal grooves by hand even more challenging. When hand washed, such plastic container lids are also typically left to air dry. This air drying invariably results in a small amount of water remaining at the bottom of each plastic container lid in the seal grooving. When the plastic container lid is picked up to be put away, the remainder of that water splatters out. If plastic container lids are left out overnight to dry, the seal grooving area can harbor germs, especially if food residue is present.

Modern automatic dishwashers provide a superior environment for thoroughly cleaning such plastic container lids. Most modern dishwashers provide a wash cycle using water at a temperature of at least twice that of typical tap water. Improvements in water jet dispersion within a dishwasher have also improved the cleaning thoroughness of automatic dishwashers. A heated drying environment thoroughly dries the plastic container lids, while killing any germs that may have been left behind after washing.

Automatic dishwashing of such plastic container lids presents several challenges. For example, plastic container lids are often "freely" placed in the dishwasher and may or may not be anchored in place by other items. During the wash cycles within the dishwasher, such plastic container lids often become dislodged from their position within a dishwasher and end up coming in contact with the dishwasher heating element, which usually melts the plastic container lids and renders the plastic container lids unusable or damages them in such a way as to diminish their effectiveness. Even if a plastic container lid does not come in contact with the heating element, it is difficult to retain plastic container lids in a position that will assure a thorough cleaning particularly of the groove around the edge of the plastic container lid. Therefore, to provide consistent and thorough wash results in an automatic dishwasher, it is critical to (1) prevent the plastic container lids from moving around during the wash cycle and (2) make sure that wash water exiting the water spraying jets within the dishwasher is able to contact all areas of each plastic container lid. The present invention is specifically designed to achieve these aims by positioning the plastic container lids in the flow path of the streams of water exiting the water spraying jets within a dishwasher.

The plastic lid container of the present invention is configured to retain multiple plastic container lids in a stable and upright position, while maintaining spacing between each adjacent plastic container lid. In addition, the plastic lid container of this present invention is designed to maximize the amount of wash water that is directed onto the plastic container lids retained therein and, in particular, the grooves used to fasten the plastic container lids to matching containers.

In the description of the drawing figures, the same numbers will be used throughout to refer to the same or similar components. While the plastic lid container may be used to store plastic container lids and other relatively small household articles of a size and shape suitable for containment in a dishwasher and the like, such articles and lids are referred to herein as plastic container lids for convenience. The term "small" as used herein refers to articles which are of a size which is readily placed in the plastic lid container of the present invention.

Referring to FIG. 1, a plastic container lid storage and washing device 10 according to the invention has a top 12, a bottom 14, an open end 16, a closed end 18, a right side 20 and a left side 22, all of which being formed of an "open structure." For the purposes of the specification and claims, the term "open structure" means a structure having openings that are sufficiently large to allow water to pass therethrough.

The open end 16 of device 10 is connected to top 12 and sides 20, 22 and the closed end 18 is connected to top 12, bottom 14 and sides 20, 22 to form a generally rectangular or box shaped parallelepiped structure. The open end 16 includes a door 24 supported by hinges 26, 28, 30 to enable a user to open and close one end of the device 10. Latches 32, 34 and 36, 38 are used to secure the door 24 in a closed position.

As will be described herein, the door 24 is preferably removable. With the door 24 removed, the plastic lid container 10 can be stood on the closed end 18, which allows the plastic lid container 10 to accommodate larger plastic container lids.

Desirably the top 12, bottom 14, sides 20, 22 and end 18 of the plastic lid container 10 are formed of a generally open structure, which readily promotes the flow of air or water through the plastic lid container 10 for contact with the plastic container lids, as for instance in storage, or liquids and air in a dishwasher or the like. The open structure may be formed of rails and cross slats, ornamental figures or the like. The primary function of the open structure is to support and protect the plastic container lids inside the plastic lid container 10 while permitting the ready flow of air and liquids into and out of the plastic lid container 10. In addition, as can be seen in FIGS. 1, 3, 4 and 8, the outward-facing surfaces of most of the portions of the plastic lid container 10 are rounded and convex, and the inward-facing surfaces of most of the portions of the plastic lid container 10 are substantially flat. This configuration minimizes and directs the reflection of the water streams that are directed toward the plastic lid container 10 from dishwasher cleaning jets (not shown) and encourages the reflection of water streams moving inside the plastic lid container 10 as such water streams contact inwardly-facing surfaces of the plastic lid container 10.

Figure 2:
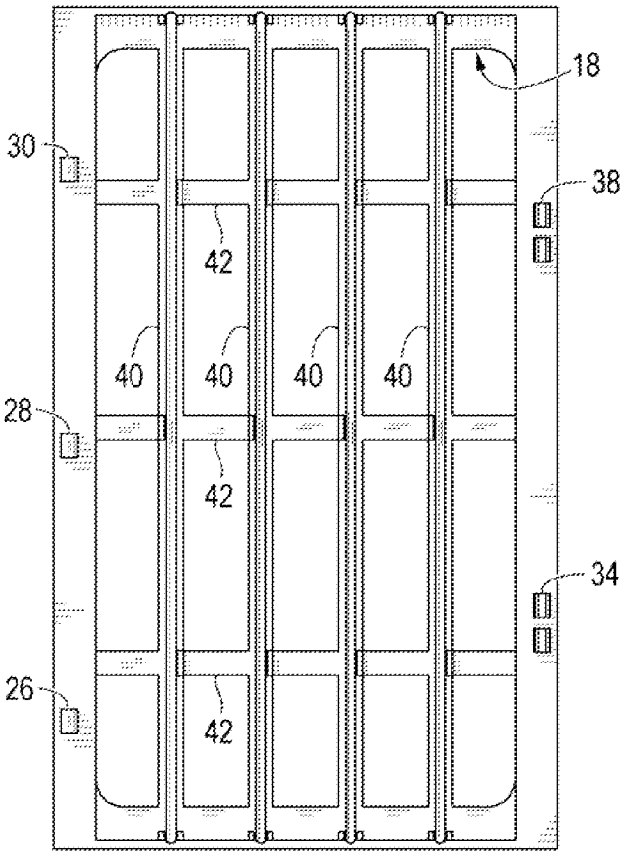
FIG. 2 is an elevational view of the front side of the plastic lid container taken from the left side of FIG. 1 with the door removed to show details of the door hinge.

Referring to FIG. 2, the closed end 18 of the plastic lid container 10 has an open structure including main or longitudinal grooved rails 40 and cross-slats 42. The grooved rails 40 and cross-slats 42 may be of any convenient width and presented in any desired number so long as the resulting structure is sufficient to maintain the plastic container lids in a selected position and to permit water, detergent and air to contact the plastic container lids (at various stages of the wash and dry cycle).

Each of the grooved rails 40 includes projections (e.g., 44 of FIG. 1), which are located on the inward-facing surfaces of the grooved rails 40 and are used to contain the plastic container lids in a desired position or to maintain the plastic container lids in an upright or semi-upright position and to slightly separate the plastic container lids one from another. The height of each of the projections 44 is no greater than about 0.5 inches and is preferably a small fraction of the overall height of the plastic lid container 10 (i.e., the distance from the top 12 to the bottom 14). In this embodiment, the preferred height of the projections 44 is in the range of about 0.125 to about 0.25 inches and the overall height of the plastic lid container 10 is preferably no less than about 8 inches, to accommodate a wide range of common plastic container lid sizes.

Figure 6B:
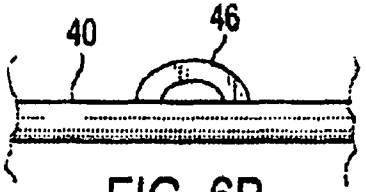
FIG. 6B is an enlarged fragmentary elevational view of another projection for maintaining plastic container lids in position.
Figure 6C:
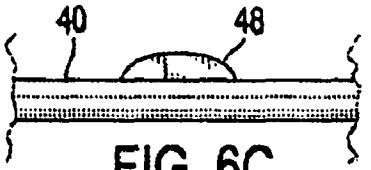
FIG. 6C is an enlarged fragmentary elevational view of yet another projection for maintaining plastic container lids in position.
Figure 6D:
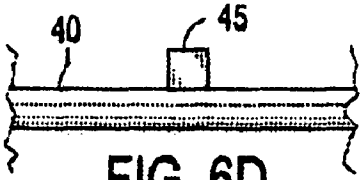
FIG. 6D is an enlarged fragmentary elevational view of still another projection for maintaining plastic container lids in position.
Figure 6E:
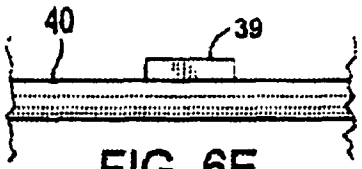
FIG. 6E is an enlarged fragmentary elevational view of still yet another projection for maintaining plastic container lids in position.
Figure 6A:
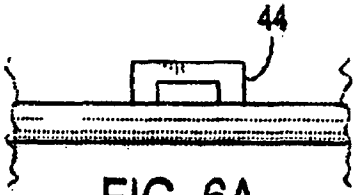
FIG. 6A is an enlarged fragmentary elevational view of a projection for maintaining plastic container lids in position in the plastic lid container of FIG. 1.

The projections 44 may be of a variety of configurations, such as a tab channel shaped projection 44 shown in FIG. 6A, an arc shaped projection 46 as shown in FIG. 6B, a solid semi-circular projection 48 as shown in FIG. 6C, a square shaped solid projection 44 shown in FIG. 6D, or a solid rectangular shaped projection 39 shown in FIG. 6E. It should be understood that the projections shown in FIGS. 6A-6E can be positioned on rails 40, 41 located on the top 12, bottom 14, or closed end 18 of the plastic lid container 10.

Top 12 and bottom 14 are formed with an open structure similar to the closed end 18. As shown in FIGS. 5A-5E, the rails 40, 41 of top 12, bottom 14 and end 18 have a cross-section including a groove 51 formed therein so that a lid having different profiles may be supported in an upright position. Each of the rails 40 on closed end 18 is preferably aligned with a corresponding rail 41 on both the top 12 and bottom 14 in the preferred embodiment.

Figure 5E:
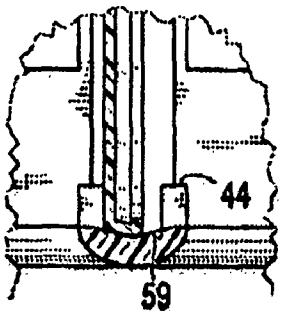
FIG. 5E is an elevational view identical to FIG. 5A illustrating a still further configuration for the groove.
Figure 5B:
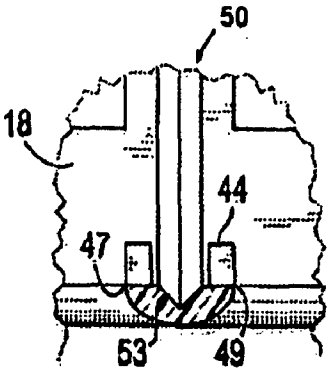
FIG. 5B is an elevational view identical to FIG. 5A illustrating an alternate configuration for the groove.
Figure 5D:
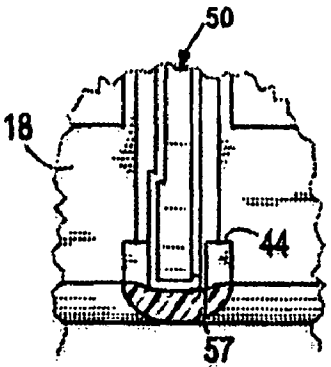
FIG. 5D is an elevational view identical to FIG. 5A illustrating a still further configuration for the groove.
Figure 5A:
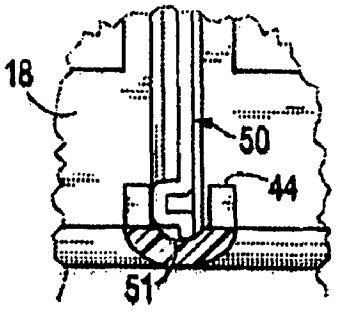
FIG. 5A is an enlarged fragmentary elevational view illustrating a particular cross-sectional shape of the groove.
Figure 5C:
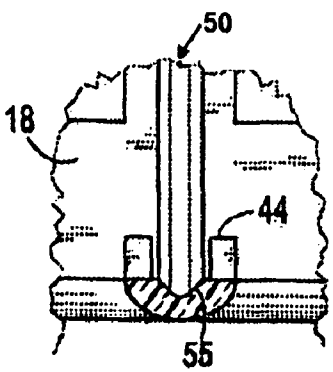
FIG. 5C is an elevational view identical to FIG. 5A illustrating yet another configuration of the groove.
Figure 8:
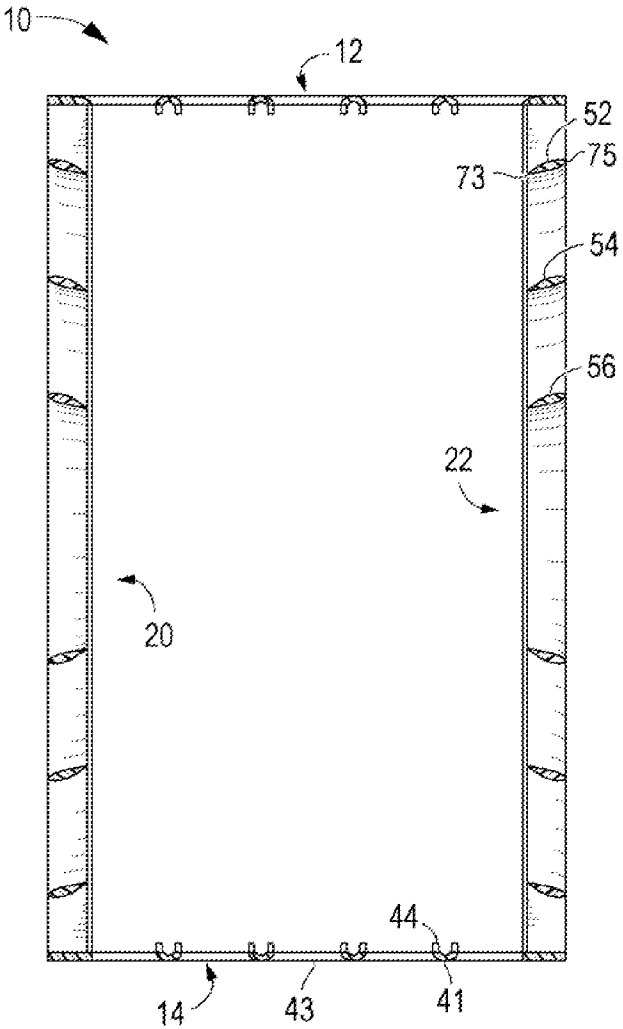
FIG. 8 is an elevational view in partial section taken along lines 8-8 of FIG. 7.

Those of ordinary skill in the art will understand that a wide variety of groove shapes may be used. FIG. 5A shows a groove 51 having a generally semi-circular cross-section. FIG. 5B shows a groove 53 having a "V" shaped cross-section. FIGS. 5C, 5D and 5E show other alternative cross sectional shapes for grooves 55, 57, 59, respectively. The common feature of all of the grooves 51, 53, 55, 57, 59 is that each includes a low point that is centered on the rail 40, 41 on which it is located. This centering of the groove on the rail promotes proper positioning and retention of the plastic lid when the plastic lid is inserted and removed from the plastic lid container 10, as well as during a wash cycle. In order to facilitate easy insertion and removal of plastic container lids, the rails 40 and the grooves 51 are preferably parallel to the sides 20, 22 of the device 10.

Figure 3:
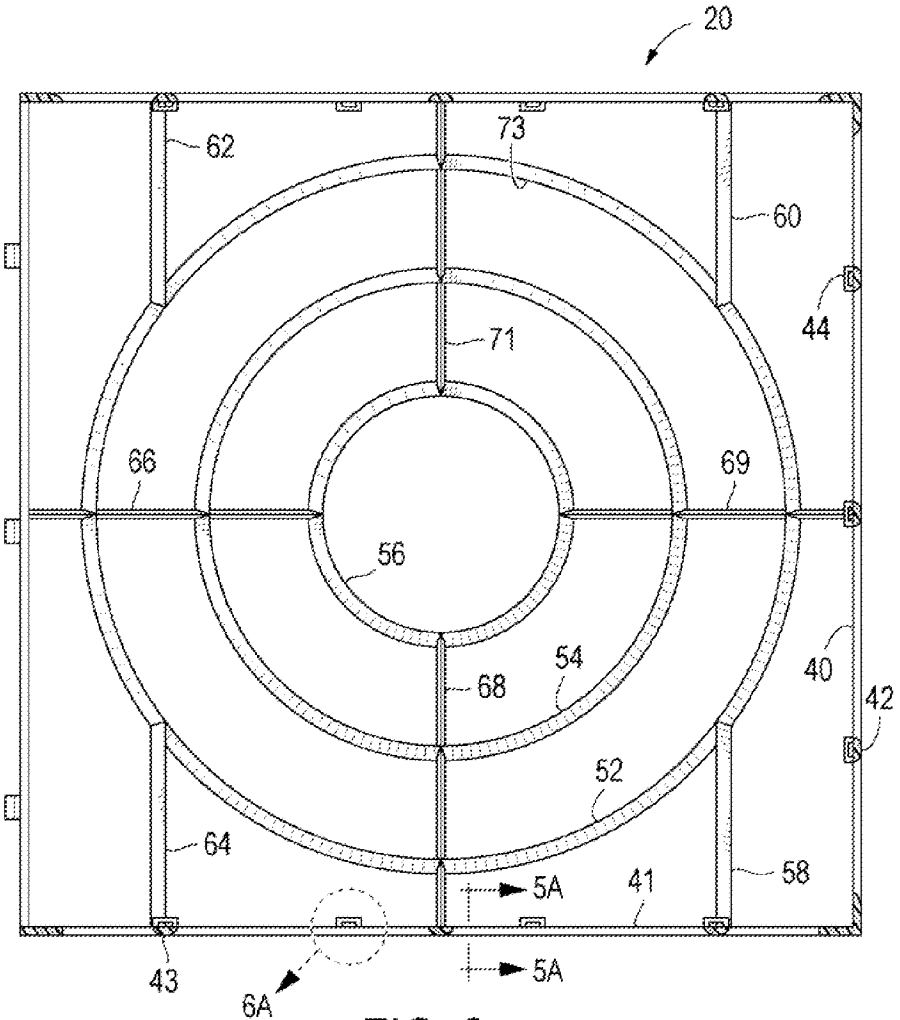
FIG. 3 is an elevational view of the left side of the plastic lid container taken along lines 3-3 of FIG. 1.

Referring to FIG. 3, the structure of side 20 includes three concentric circular members 52, 54, 56, which are supported by vertical supports 58, 60, 62, 64, 68, 71 and horizontal supports 66, 69. Preferably, each of the circular members 52, 54, 56, vertical supports 58, 60, 62, 64, 68, 71 and horizontal supports 66, 69 has an airfoil-shaped cross-sectional shape. Each of the circular members 52, 54, 56 and vertical supports 58, 60, 62, 64 is preferably angled so that its inwardly-facing edge 73 has a smaller circumference than its outward facing edge 75. This orientation is most visible in FIGS. 4 and 8. For example, the inward-facing edge 73 (see FIG. 8) of circular member 52 is closer to the center of the side 20 (i.e., has a small circumference) than the outward-facing edge 75 (see FIGS. 7 and 8) of circular member 52. As with most of the structural members of the device 10, the circular members 52, 54, 56, vertical supports 58, 60, 62, 64, 68, 71 and horizontal supports 66, 69 are configured to be open to the flow of fluids and air into and through the device 10. In this embodiment, side 22 is a mirror image of side 20, except for parts that engage the door 24.

Figure 4:
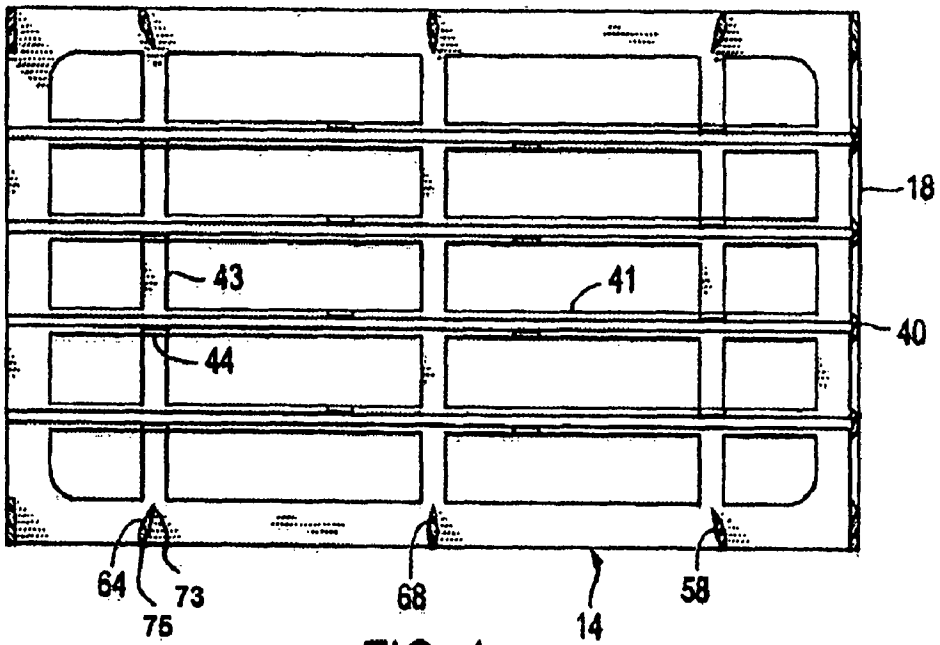
FIG. 4 is a plan view of the bottom of the plastic lid container taken along lines 4-4 of FIG. 1.

Referring to FIG. 4, bottom 14 has longitudinal rails 41 and cross slats 43, which are similar in structure to the longitudinal grooved rails 40 and cross slats 42 located on the closed end 18. The relative size and configuration of the rails 41, projections 44 and grooves 51 are shown in FIGS. 5A through 5E. Preferably, the projections 44 are located between the groove 51 and either the left edge 49 or right edge 47 of the rail 41 in an alternating pattern. The alternating pattern of the projections is visible in FIGS. 1, 2 and 4.

While open end 16 of the plastic lid container 10 as shown in FIG. 1 is fitted with a door 24, it should be understood that either end of device 10 (or both ends) could be fitted with a door so long as the ends 16, 18 can be maintained in a closed position during use of the plastic lid container 10 in a dishwasher or the like.

Figure 10:
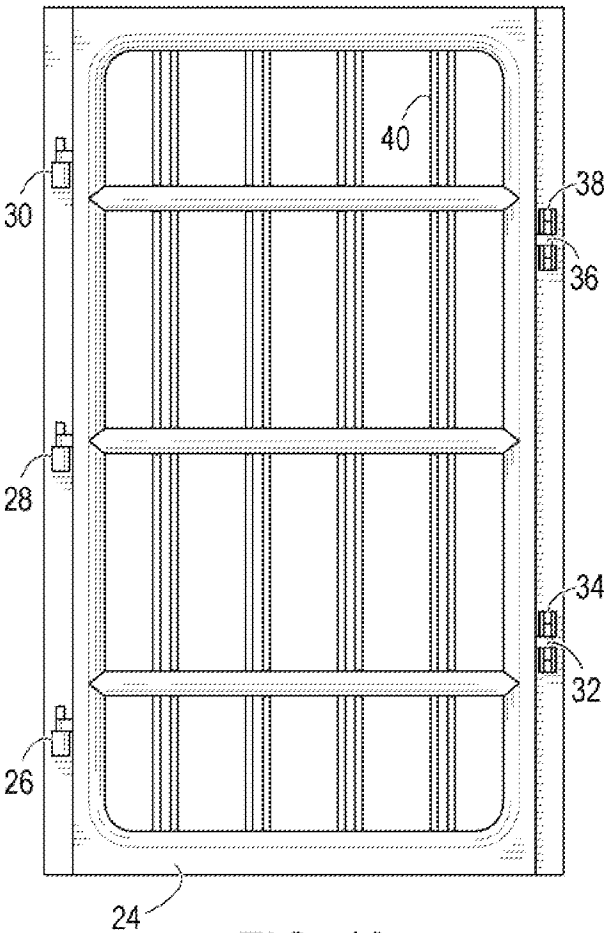
FIG. 10 is a front elevational view of the device and the door according to the present invention.

The door 24 may be positioned with hinges 26, 28, 30 or other devices known to the art to permit a user to open and close the plastic lid container 10. Positioning of the door 24 at the open end 16 of the plastic lid container 10 is preferred. The door may be removably hinged on the plastic lid container 10 and may be held in a closed position by a latch or latches 32, 34 and 36, 38 (FIG. 9), by clips, by frictional engagement of the door fitted into a shadow box like opening in the body of the plastic lid container 10 and the like. FIG. 10 shows door 24 in the closed and latched position.

Figure 7:
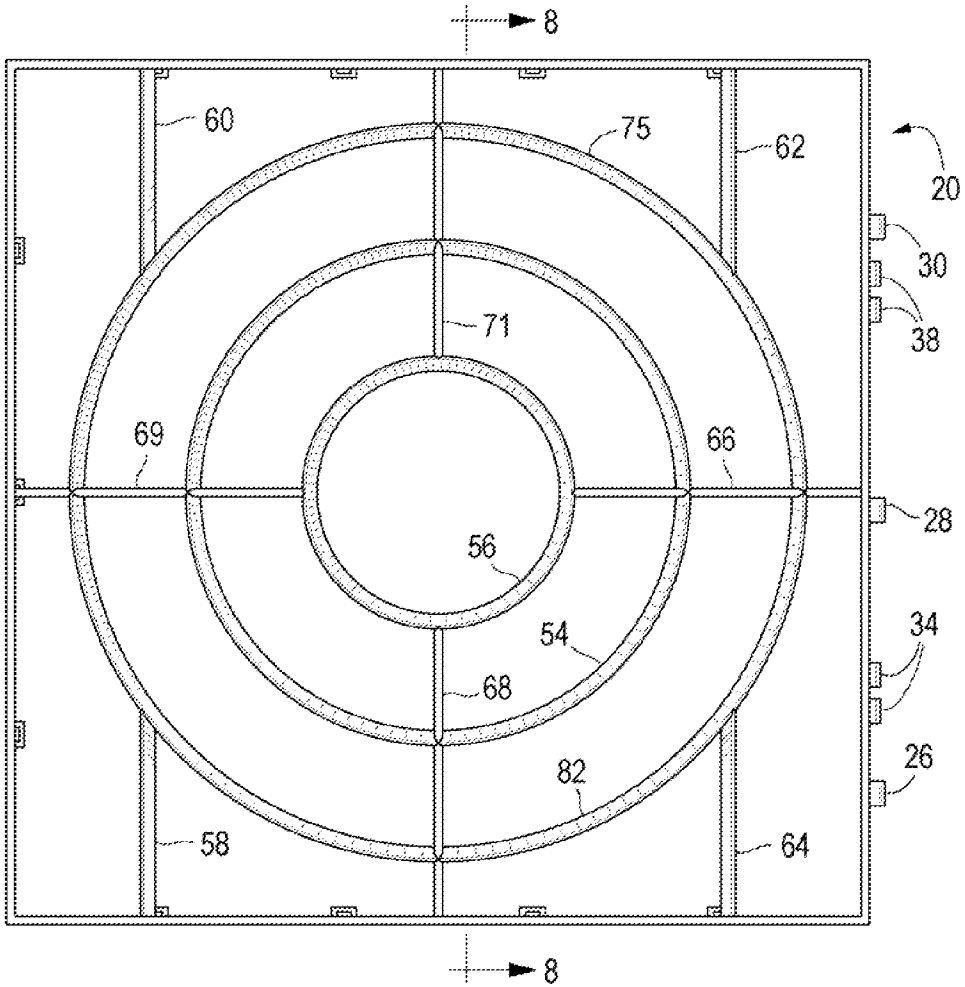
FIG. 7 is an elevational view of the right side of the plastic lid container shown in FIG. 1.
Figure 9:
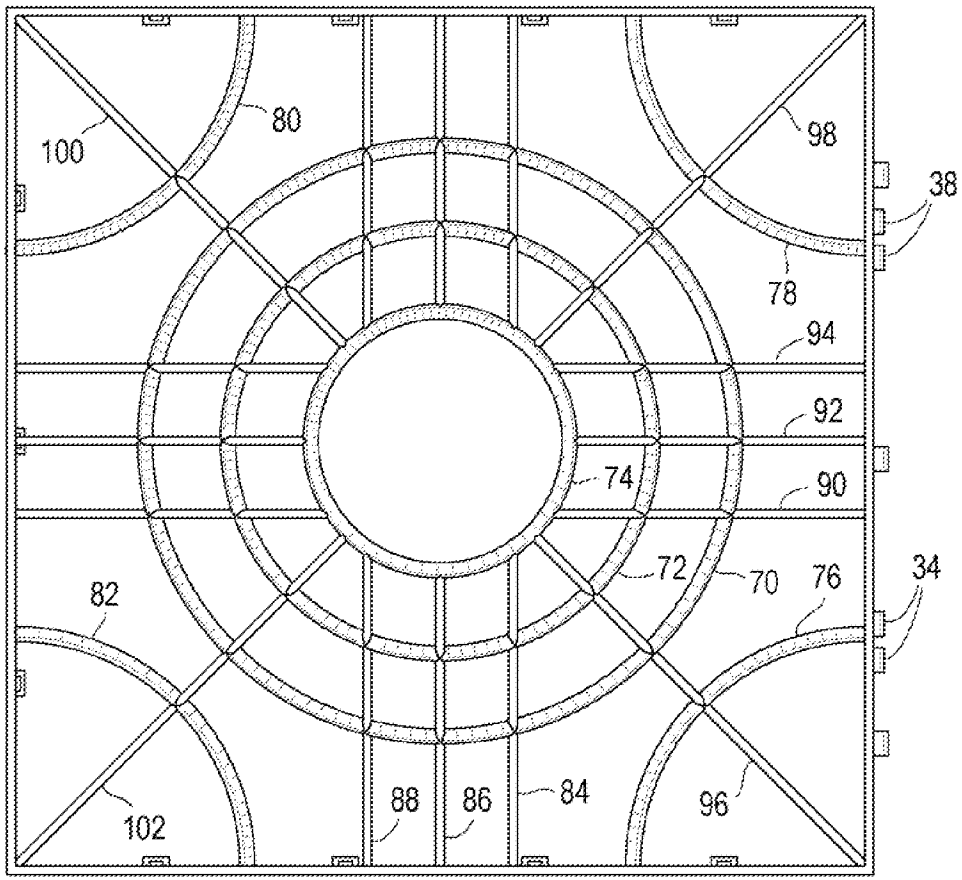
FIG. 9 is an elevational view of an alternate pattern for the sides of the plastic lid container of FIG. 1.

The plastic lid container 10 may be fabricated with an open structure of various shapes, such as shown in FIGS. 1, 3 and 7. In FIG. 9, an alternate configuration for the side members 20, 22 is shown, comprising rings 70, 72, 74, arcs 76, 78, 80, 82 with vertical support slats 84, 86, 88, horizontal support slats 90, 92, 94 and diagonal support slats 96, 98, 100, 102. Other variations of support slat configurations could be used. The primary requisite of the open structure is that it be open to the flow of air and liquids and that it provide sufficient strength to protect the plastic container lids and to prevent the escape of the plastic container lids from the inside of the plastic lid container 10 during storage, use in a dishwasher, or the like.

The cross-sectional shapes of the structural members of the plastic lid container 10 can have a tapered cross-sectional shape designed to permit the ready flow of liquids and air into the plastic lid container 10 as described above. While other configurations could be used, the tapered or air foil configuration is a preferred cross-sectional configuration for the slats and other structural components.

Figure 11B:
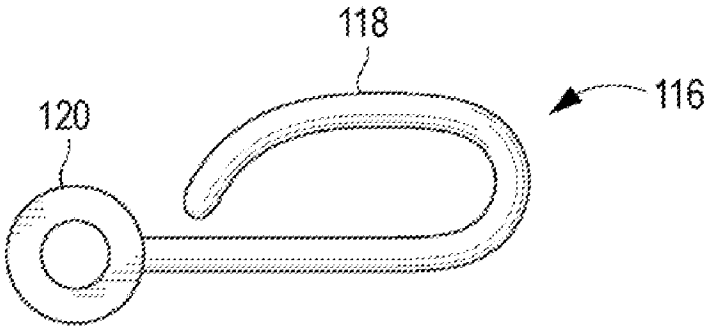
FIG. 11B is a side elevational view of an alternate accessory for securing the plastic lid container of FIG. 1 to an internal component of a dishwasher.
Figure 11A:
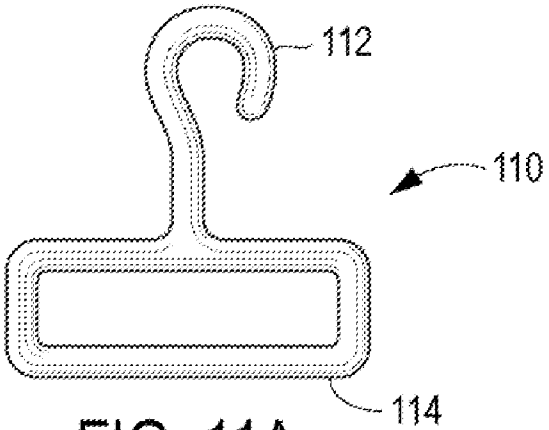
FIG. 11A is a side elevational view of an accessory for securing the plastic lid container of FIG. 1 to an internal component of a dishwasher.

FIG. 11A shows a fastener accessory 110 having the general shape of a coat hanger, for use in positioning and securing the plastic lid container 10 to a dishwasher rack by placing the hook portion 112 on one of the slats of the plastic lid container 10 and the loop portion 114 to a portion of the dishwasher rack (not shown). A plurality of fasteners is typically positioned on the plastic lid container 10 for use in maintaining the plastic lid container 10 in position in a dishwasher.

Figure 11C:
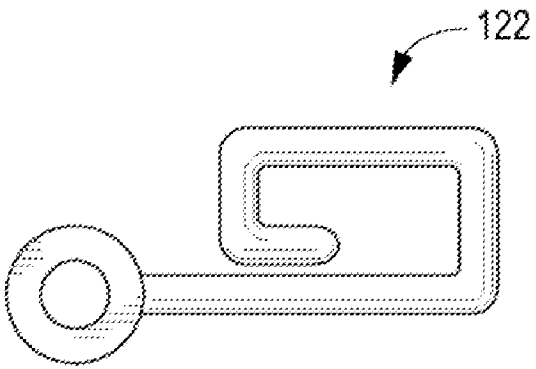
FIG. 11C is a side elevational view of yet another accessory for securing the plastic lid container of FIG. 1 to an internal component of a dishwasher.

Alternatively, as shown in FIG. 11B, a resilient clip accessory 116 having a spring-like portion 118 which is adapted to resiliently engage a support slat of the plastic lid container 10 and eye portion 120 adapted to slip over a coated wire or the like in a dishwasher rack. FIG. 11C illustrates a fastener accessory 122, similar in construction to the resilient clip accessory of FIG. 11B, which accessory 122 may be used to secure the plastic lid container 10 in a desired position in a dishwasher.

Figure 12:
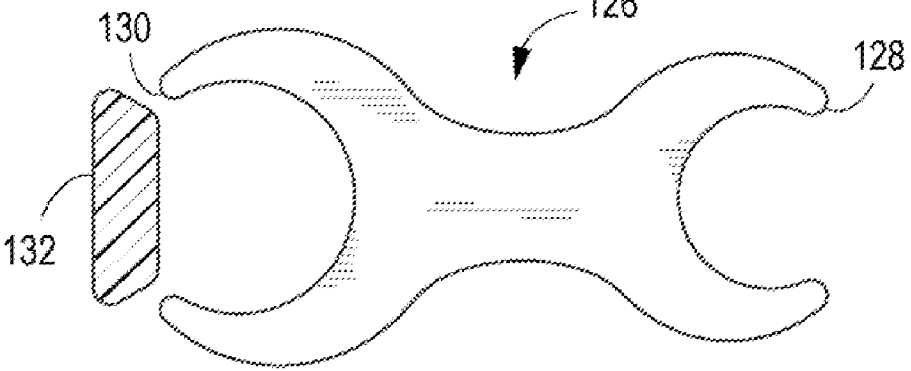
FIG. 12 is a side elevational view of an alternate fastener for use in securing the plastic lid container of FIG. 1 shown in relationship to a vertical member of the plastic lid container.

As shown in FIG. 12, a clip or fastening accessory 126 with open jaw like ends 128, 130 clips onto a vertical member 132 of the plastic lid container 10 and end 128 is adjusted to clip onto adjacent vertical dish supporters of a dishwasher rack.

Referring to FIG. 1 and FIG. 10, the hinges 26, 28, 30 used for door 24 can be of any suitable type. A simple plastic hinge comprising a sheet of flexible plastic could be used. Alternatively, as shown in the drawings, the hinges have a section mounted on the door having a vertical projecting pin for mating with an aperture or hole in a projecting arm on the door, the arm fitting over the pin.

Latches 32, 34 and 36, 38 used with door 24 of the plastic lid container 10 can be a hasp-like latch, a hook or any other suitable latch of the many types known to those skilled in the art for such purposes. As shown in FIG. 1 and FIG. 10, a T-shaped pin on the door is fitted to mate with a complementary shaped barrel lock on open end 16 of the plastic lid container 10.

The plastic lid container 10 can be constructed in any size desired. Size will be determined by the size of the plastic container lids to be contained therein. Lids, such as plastic lids for plastic containers, plastic lids for other types of containers or non-plastic lids and other relatively small articles can be contained within plastic lid container 10. It is anticipated that commercial devices will be produced to accommodate a variety of plastic container lid sizes and number of plastic container lids stored.

The plastic lid container 10 may be fabricated from a variety of materials, e.g., plastic or rubber, having sufficient strength and stability for use in environments seeing temperatures up to about 250° F. Plastic or rubber coated metal wires can also be used to fabricate the plastic lid container 10.

The unique design features of the plastic lid container 10 of the invention are unlike anything currently in the marketplace with overall dimensions of about 10½ to about 10¾ inches in height; about 5 inches wide and about 12 inches in length. The overall design is open, yet somewhat flexible in its makeup. The angles and curves of the structure work to promote maximum wash and dry exposure. Its inner components provide stability to plastic container lids no matter where the plastic lid container is placed in the dishwasher, yet the inner components do not hinder storage capabilities and the door is removable. A large plastic lid container 10 can store between ten and twelve large plastic container lids; a medium-sized device, eight to ten plastic container lids; and the small device, five to seven plastic container lids.

While the present invention has been described by reference to certain of its embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of the embodiments.

The invention claimed is:

1. An apparatus for positioning plastic container lids for washing in a dishwasher, said apparatus comprising:

an open structure body having a top, bottom, left side and right side, a closed end and an open end, said bottom including a plurality of grooved bottom rails, each of the plurality of grooved bottom rails being parallel to said left and right sides and having an inward-facing surface and an outward-facing surface;

said top including a plurality of grooved top rails, each of said plurality of grooved top rails being parallel to said left and right sides and having an inward-facing surface and an outward-facing surface;

a plurality of projections located along the inward-facing surface of each of said plurality of grooved bottom rails and the inward-facing surface of said grooved top rails;

a removable door located at said open end, said removable door having an open structure;

whereby objects contained within said open structure are positioned by placement of the edges of said objects into said grooves in said bottom rails and between said projections in said grooved bottom rails.

2. The apparatus as defined in claim 1 wherein said closed end includes a plurality of grooved end rails, each of said plurality of grooved end rails being parallel to said left and right sides and having an inward-facing surface and an outward-facing surface, wherein a plurality of projections are also located along said inward-facing surface of each of said plurality of grooved end rails.

3. The apparatus as defined in claim 2, wherein each of said plurality of grooved bottom rails is aligned with one of said plurality of grooved top rails and one of said plurality of grooved end rails.

4. The apparatus as defined in claim 3, wherein each of said plurality of grooved bottom rails includes a left edge and a right edge and each of said plurality of projections is located between said groove and either said left or right edge of that one of said plurality of bottom rails.

5. The apparatus as defined in claim 4, wherein said plurality of projections are arranged in an alternating pattern on each of said plurality of grooved bottom rails.

6. The apparatus of as defined in claim 5, wherein said inward-facing surface of each of said plurality of grooved bottom rails is substantially flat and said outward-facing surface of each of said plurality of grooved bottom rails is convex.

7. An apparatus comprising:

a body having an open structure, said body including a top, a bottom, a left side, a right side, a closed end and an open end;

a plurality of rails parallel to said left and right sides extending along said top and said bottom from said open end toward said closed end, each of said plurality of rails having a substantially flat inward-facing surface and a convex outward-facing surface and a plurality of projections;

a plurality of grooves parallel to said left and right sides, each of said plurality of grooves being located on the inward-facing surface of said plurality of rails and extending from said open end toward said closed end;

wherein each of said plurality of rails includes a left and right edge and each of said plurality of projections is positioned between one of said plurality of grooves and either said left or right edge;

whereby objects contained within said open structure are positioned by the placement of said objects into said grooves.

8. An apparatus comprising:

a body having an open structure, said body including a top, a bottom, a left side, a right side, a closed end and an open end, said left side and said right side each including a circular member;

said left and right sides each including a plurality of concentric water direction members;

each of said water direction members having an outward-facing edge and an inward-facing edge, said outward-facing edge of each one of said plurality of circular water direction members having a larger circumference than said inward-facing edge of that one of said plurality of circular water direction members;

a plurality of grooved rails extending along said top and said bottom from said open end toward said closed end; and a plurality of projections located along said inward-facing surface of each of said plurality of bottom rails.

* * * * *